United States Patent [19]

Cover

[11] Patent Number: 4,605,992

[45] **Date of Patent: * Aug. 12, 1986**

[54] LIGHTING FIXTURE INSULATION

[76] Inventor: Craig H. Cover, P.O. Box 755, Newtown, Pa. 18940

[ * ] Notice: The portion of the term of this patent subsequent to Oct. 1, 2002 has been disclaimed.

[21] Appl. No.: 743,784

[22] Filed: Jun. 12, 1985

[51] Int. Cl.[4] ..... F21S 1/14

[52] U.S. Cl. ..... 362/147; 362/294; 362/369; 362/373; 362/408

[58] Field of Search ..... 362/294, 373, 147, 369, 362/408

[56] References Cited

U.S. PATENT DOCUMENTS

| | | | |
|---|---|---|---|
| 4,104,713 | 8/1978 | Chan et al. | 362/294 |
| 4,234,916 | 11/1980 | Goralnik | 362/294 |
| 4,302,798 | 11/1981 | Sit | 362/373 |
| 4,356,540 | 10/1982 | Goralnik | 362/294 |
| 4,507,719 | 3/1985 | Quiogue | 362/294 |
| 4,514,792 | 4/1985 | Klaus | 362/294 |

*Primary Examiner*—E. Rollins Cross

*Attorney, Agent, or Firm*—Gregory J. Gore

[57] ABSTRACT

The present invention is directed to a lighting fixture thermal insulating system which incorporates the space-age technology of layered metallized polymer insulation. The present invention utilizes a structure and combination which yields an insulation system of superior performance while being cost competitive and because of reduced space requirement creates greater freedom of design in the manufacture of lighting fixtures. The laminations of metallized polymer and a spacer material may be located above or below the mounting pan or both. For reasons of economy, simple aluminum foil may be used to replace the metallized polymer with only slightly reduced performance.

8 Claims, 4 Drawing Figures

LIGHTING FIXTURE INSULATION

BACKGROUND OF THE INVENTION

1. Field of the Invention

This invention pertains to lighting fixture insulation and is designed to be used in the mounting apparatus for lighting fixtures to insulate the heat generated in the lighting fixture from the supporting building structure, such as a wall or ceiling as well as the outlet box to which it is affixed. This type of insulation system is mentioned in my co-pending applications Ser. Nos. 538,172, filed Oct 3, 1983, now U.S. Pat. No. 4,544,992 and 700,869 filed Feb. 11, 1985 now abandoned.

2. The Prior Art

General safety requirements within the light fixture industry are set by Underwriters' Laboratories which must be closely adhered to. Many efforts have been made through the use of structure, ventilation, heat dissipation and heat insulation in order to meet these safety requirements and also fulfill the asthetic requirement of a commercially viable lighting fixture. There are numerous patents in this field, among them which may be mentioned as relevant to the instant application are Pat. Nos. 4,044,246, 4,104,713, 4,234,916, 4,302,798 and 4,356,540. All of these referenced patents seek to propose solutions to the heat transfer problem mentioned above but none has achieved the same results and none has employed the method of the instant invention.

Prior art solutions to the problem of heat conductivity to the electrical outlet box and to adjacent building materials have been structural designs which reduce the amount of heat conductivity between the fixture pan and the outlet box. The instant invention on the other hand reduces the amount of heat transfer by reducing the amount of heat transmitted to the lighting fixture pan and outlet box with intermediate layers of insulation as described below.

SUMMARY OF THE INVENTION

The present invention discloses the first known successful application of a metallized polymer insulation to lighting fixtures. The material is laminated between spacer material and applied in a specific fashion to be used either in the pan area of the lighting fixture mount or between the pan and the lightbulb. Because of the effectiveness of this insulating system, manufacturers may realize much greater freedom of design and reduced labor costs in constructing and assembling a complete insulated light fixture. The performance of this insulating system is due in part by the use of metallized polymer, and in part due to the unique laminated structure. Other metallic compositions may be substituted for the metallized polymer with surprising and unexpected results. Four or more layers should be used for best results.

The system as further disclosed herein uses a low-emissivity metallized polymer which is built-up in sandwich-like layers between alternating layers of a spacer material. For cost reasons, the most appropriate polymer substrate to be used in the light fixture industry are those such as polyethylene, polyethyleneterephthalate (PET), polypropylene and various flourocarbon films. The spacer material is between ½ and ¼ inch thick and may be made of varying densities of fiberglass, ceramic paper, NOMEX or any one of a number of other fire retardant materials or combinations thereof. An additional function of the spacer material is to further ensure that there is no metal to metal contact between layers of the metallized film or between the metal parts of the lighting fixture and the metallized side of the polymer film. The metal used is aluminum which is vacuum deposited on the polymer substrate.

More specifically, the insulation system disclosed herein is constructed using two or more layers of metallized polymer. Each layer consists of a layer of spacer material laminated to a layer of low-emissivity metallized polymer film. The number of layers and their placement will vary with the size and shape of the fixture. For example, many fixtures do best with a configuration of a two-layer section installed on the face of the mounting pan and a second two-layer section placed inside the mounting pan. Approximately the same performance will be observed by installing all four layers on the face with no insulation in the pan. The choice will depend on the manufacturer's preference, taking into account fixture size, shape, asthetics and so on.

It is imperative in the application of the insulating material to the lighting fixture body that the metallized side of the polymer film be oriented towards the lightbulb regardless of whether the layers are installed on the face or in the pan. This means that, if the material is to be used inside of the pan, the first layer or the layer closest to the heat source, wnich would necessarily touch the metal face of the pan, will be the fiberglass spacer material and the second layer will be the metallized polymer with the metallized side facing the heat source with successive layers in similar orientation.

With this insulating material used on the face of the pan, the first layer does not begin with spacer material, but a foil covering which prevents scorching. This is followed by successive layers of metallized polymer and fiberglass.

One of the advantages of this system is the reduced requirement of insulation space. This makes possible many new and interesting fixture designs as well as removing the difficulty of installation. Furthermore, the reduced depth of insulation reduces the installation time and cost which often is otherwise lessened during installation by workers who remove insulation to make installation easier. This results in a final product which is inherently safer for installation reasons alone. In laboratory tests using U.L. test procedures, it has been shown that the current insulation system requiring 2⅛ inch of insulation can be replaced with the laminated metallized polymer system as described above with a total insulation thickness of only one inch. This improvement is, therefore, not only a commercial benefit for the lighting fixture industry, but also results in a safer product for the consumer.

The invention disclosed herein describes a lighting fixture having a mounting pan for ceiling or wall mounting and a lightbulb with the improvement comprising; thermal insulation affixed to said mounting pan, said insulation comprising the combination of a polymer film, a metal vacuum deposited on said polymer film, and spacer material located between successive layers of the metallized polymer.

Accordingly, it is an object of the invention to provide an improved lighting fixture which is of the low heat transfer type and is relatively inexpensive to manufacture.

It is a further object of the instant invention to provide a lighting fixture of a low heat transfer type which is compact, occupies very little space, and is easy to install.

DESCRIPTION OF THE PREFERRED EMBODIMENT

Figure 1:
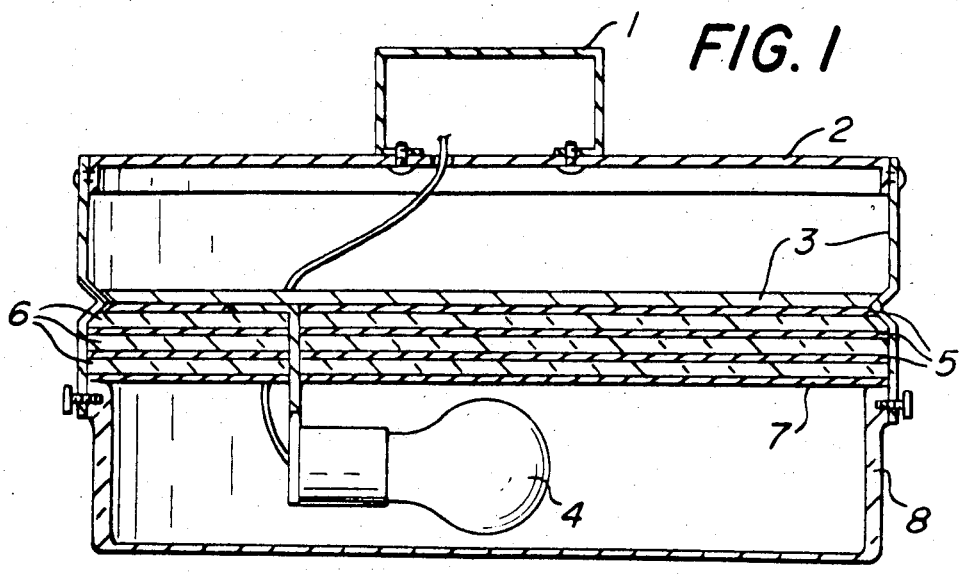
FIG. 1 is a vertical sectional view through a lighting fixture in accordance with the invention using the layer of insulation below the pan only.

FIG. 1 shows the vertical cross-sectional view of a typical lighting fixture which incorporates the laminated insulation as described above. Outlet box 1 is affixed to mounting pan 3 by the usual mounting screws which generally accomodate a crossbar member 2 with adjustable slotting. The mounting pan 3 is then affixed to the crossbar 2 in any one of many commonly used techniques, usually by direct bolting. A three-layer composition of insulating material is shown mounted directly below the face of the mounting pan directly above the lightbulb 4. Sheets of 92-gauge metallized polmer 5 are separated by spacing material 6 which in this case is ¼" fiberglass. Polymer sheets 5 have bottom surfaces metallized with aluminum and in each case the metallized side of the polymer material is facing the lightbulb. Protective foil sheet 7 is placed between the lightbulb and a first layer of metallized polymer and spacer material in order to prevent scorching.

Figure 2:
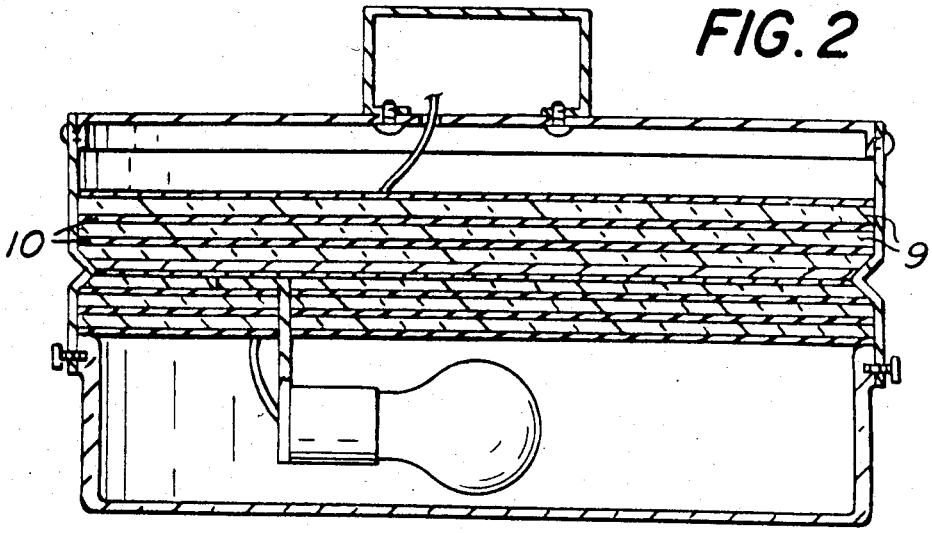
FIG. 2 is a vertical sectional view of the lighting fixture showing the location of the thermal insulating material when used both above and below the mounting pan.
Figure 3:
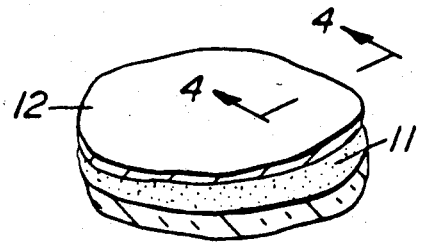
FIG. 3 is an isometric view of the thermal insulating material showing the layered construction.

This construction may be used as fully described to this point or further with the aid of additional insulating materials located inside the mounting pan just above the face of the pan as depicted in FIG. 2. In this case, the insulating material begins with the first layer being fiberglass spacer material 9 followed by a layer of the metallized polymer, 10 with the metallized face on the down side, and a second layer of fiberglass, and so on.

It should be noted that the fiberglass spacing material used as described herein, may be replaced by many other suitable materials previously mentioned without much effect on the insulating properties of the metallized polymer. The only requirement of the metallized polymer is that it be of the low-emissivity type, that is, having an emissivity of $0.03 \pm 0.005$. This may be of the type manufactured by National Metallizing, a Division of NMD, Inc., Princeton, N.J., under the name "Polymet." Polymer substrate provides an inexpensive reflective insulating mechanism.

Figure 4:
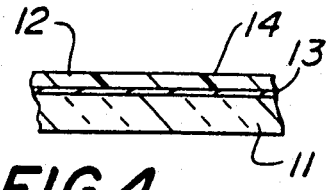
FIG. 4 is a cross-sectional view of the laminated insulation of FIG. 3 also showing the two-sided nature of the metallized polymer.

It should be understood that there may be many combinations of materials possible for the essential elements necessary to carry out the insulating system described above as shown in FIG. 4; a polymer substrate 14, metal vacuum deposited on the substrate 13, and spacer material 11. For example, each layer may contain a combination of a metal sheet such as aluminum and a suitable spacer material. While this elimination of the polymer substrate element is not the most effective, and therefore not the best mode of carrying out the instant invention, it may nonetheless be the most commercially desirable for reasons of cost. This two-ply alternative may be constructed using aluminum foil and ¼-inch fiberglass. The results of this alternative provide a surprising advance over prior art insulating techniques.

Furthermore, it should be understood that there may be many modifications and adaptations of the specific embodiment of the present invention as described herein and still fall within the scope and spirit of the invention. It is therefore intended that the embodiment described herein not be a limitation on the scope of the invention which shall be determined by the appended claims.

What is claimed is:

1. In a lighting fixture having a mounting pan for ceiling or wall mounting, thermal insulation affixed to said mounting pan, and a lightbulb, the improvement comprising; a batt of thermal insulation containing two or more layers bonded together, each layer being two-ply and composed of metal foil and fiberglass.

2. The lighting fixture described in claim 1 wherein four or more of said layers are present.

3. The lighting fixture described in claim 2 wherein said metal foil is aluminum foil.

4. The lighting fixture described in claim 3 wherein said aluminum foil is bonded to said fiberglass with an adhesive.

5. The lighting fixture of claim 4 wherein said layers of insulation are located only between the face of the mounting pan and the ceiling or wall on which it is mounted.

6. The lighting fixture of claim 4 wherein said layers and insulation are located only between the mounting pan and the lightbulb.

7. The lighting fixture of claim 4 wherein said layers of insulation are located on both sides of said mounting pan.

8. The lighting figure of claim 2 wherein each layer is less than ½-inch thick.

* * * * *

US004605992B1

REEXAMINATION CERTIFICATE (2499th)

United States Patent [19]

Cover

[11] B1 4,605,992

[45] Certificate Issued * Mar. 7, 1995

[54] LIGHTING FIXTURE INSULATION

[76] Inventor: Craig H. Cover, 3055 Towering Pines Cove, Germantown, Tenn. 38138

Reexamination Request:
No. 90/003,398, Apr. 14, 1994

Reexamination Certificate for:

| | |
|---|---|
| Patent No.: | **4,605,992** |
| Issued: | **Aug. 12, 1986** |
| Appl. No.: | **743,784** |
| Filed: | **Jun. 12, 1985** |

[ * ] Notice: The portion of the term of this patent subsequent to Oct. 1, 2002 has been disclaimed.

[51] Int. Cl.[6] ..... F21S 1/14

[52] U.S. Cl. ..... 362/147; 362/294; 362/369; 362/373; 362/408

[58] Field of Search ..... 362/294, 373, 147, 369, 362/408

[56] References Cited

U.S. PATENT DOCUMENTS

| | | |
|---|---|---|
| Re. 28,166 | 9/1974 | Meckler . |
| 1,102,022 | 6/1914 | Edmunds . |
| 1,976,688 | 10/1934 | Dana et al. . |
| 1,992,209 | 2/1935 | Herbster . |
| 2,028,253 | 1/1936 | Spafford . |
| 2,123,071 | 7/1938 | Ballman . |
| 2,179,660 | 11/1939 | Johns . |
| 2,180,373 | 11/1939 | Sibley et al. . |
| 2,282,394 | 5/1942 | Corso . |
| 2,327,200 | 8/1943 | Lotter . |
| 2,348,617 | 5/1944 | Furedy . |
| 2,405,527 | 8/1946 | Skolnik . |
| 2,631,644 | 3/1953 | Cole . |
| 2,638,531 | 5/1953 | Levy . |
| 2,648,764 | 8/1953 | Kirlin . |
| 2,706,699 | 4/1955 | Plansoen et al. . |
| 2,709,667 | 5/1955 | Grubb et al. . |
| 2,715,449 | 8/1955 | Lemmerman et al. . |
| 2,746,892 | 5/1956 | Elfving . |
| 2,863,179 | 12/1958 | Gaugler . |
| 2,985,750 | 5/1961 | Ritz-Woller et al. . |
| 3,007,596 | 11/1961 | Matsch . |
| 3,009,600 | 11/1961 | Matsch . |
| 3,009,601 | 11/1961 | Matsch . |
| 3,018,016 | 1/1962 | Hnilicka, Jr. . |
| 3,070,968 | 1/1963 | Gardner . |
| 3,082,611 | 3/1963 | Alvis et al. . |
| 3,093,322 | 6/1963 | Boutelle . |
| 3,102,838 | 9/1963 | Hervey . |
| 3,103,156 | 10/1963 | Quin . |
| 3,108,750 | 10/1963 | Kerns . |
| 3,116,023 | 12/1963 | Van Dusen, Jr. et al. . |
| 3,122,883 | 3/1964 | Temer . |
| 3,124,853 | 3/1964 | Glaser et al. . |
| 3,125,943 | 3/1964 | Geocaris et al. . |
| 3,133,422 | 5/1964 | Paivanas et al. . |
| 3,151,364 | 10/1964 | Glaser et al. . |
| 3,153,279 | 10/1964 | Chessin . |
| 3,176,437 | 4/1965 | Lanyon . |
| 3,189,740 | 6/1965 | Wince . |
| 3,193,001 | 7/1965 | Meckler . |
| 3,202,815 | 8/1965 | Moore . |
| 3,228,645 | 1/1966 | Zurawski et al. . |
| 3,256,138 | 6/1966 | Welch et al. . |
| 3,259,052 | 7/1966 | Bradley et al. . |
| 3,262,192 | 7/1966 | Vukovcan et al. . |
| 3,265,236 | 8/1966 | Gibbon et al. . |
| 3,294,618 | 12/1966 | Busche et al. . |
| 3,301,163 | 1/1967 | Raider . |
| 3,301,165 | 1/1967 | Stanley . |
| 3,346,016 | 10/1967 | Blau et al. . |
| 3,348,465 | 10/1967 | Kruger . |
| 3,357,586 | 12/1967 | Matsch et al. . |
| 3,367,530 | 2/1968 | Kordyban et al. . |
| 3,375,322 | 3/1968 | Serio et al. . |
| 3,381,125 | 4/1968 | Cooper . |
| 3,409,766 | 11/1968 | Meckler . |
| 3,426,188 | 2/1969 | Baranowski . |
| 3,459,934 | 8/1969 | Moore . |
| 3,595,728 | 7/1971 | Robson . |
| 3,644,730 | 2/1972 | Ogle, Jr. et al. . |
| 3,647,606 | 3/1972 | Notaro . |
| 3,655,086 | 4/1972 | Trenner . |
| 3,692,977 | 9/1972 | Duhamel et al. . |
| 3,715,578 | 2/1973 | Wood et al. . |
| 3,769,146 | 10/1973 | Ravel . |
| 3,799,056 | 3/1974 | Colignon . |
| 3,810,816 | 5/1974 | Zachariades . |
| 3,814,659 | 6/1974 | Nadeau . |
| 3,841,206 | 10/1974 | Meckler . |

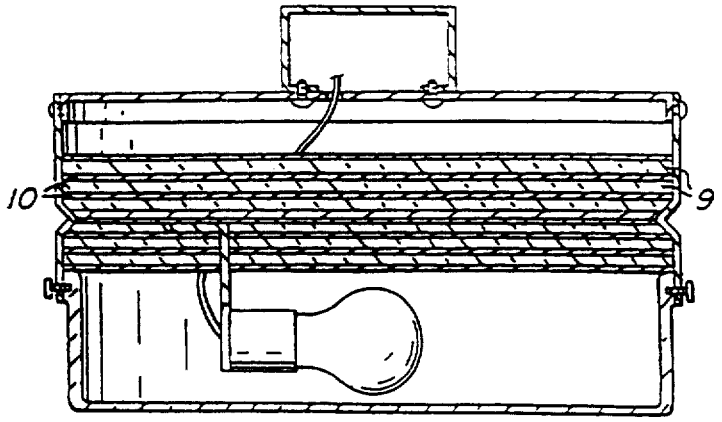

3,846,072 11/1974 Patterson .
3,902,951 9/1975 Doi et al. .
3,947,679 3/1976 Frenger .
4,044,246 8/1977 Docimo et al. .
4,054,710 10/1977 Botsolas .
4,054,711 10/1977 Botsolas .
4,055,268 10/1977 Barthel .
4,104,713 8/1978 Chan et al. .
4,107,768 8/1978 Lemkin .
4,119,479 10/1978 Williams, Jr. et al. .
4,170,675 10/1979 Greengrass .
4,172,915 10/1979 Sheptak et al. .
4,210,070 7/1980 Tatum et al. .
4,234,916 11/1980 Goralnik .
4,242,165 12/1980 Shaw .
4,278,716 7/1981 Buchner et al. .
4,302,798 11/1981 Sit .
4,312,028 1/1982 Hamacher .
4,312,909 1/1982 Shaw .
4,313,153 1/1982 Davis .
4,323,620 4/1982 Iwabuchi et al. .
4,333,750 6/1982 Helmus et al. .
4,336,575 6/1982 Gilman .
4,340,630 7/1982 Doty .
4,348,450 9/1982 Shaw .
4,356,540 10/1982 Goralnik .
4,369,222 1/1983 Hedrick et al. .
4,375,142 3/1983 McDonald .
4,400,766 8/1993 Munson .
4,446,510 5/1984 Wagner .
4,453,349 6/1984 Ryan .
4,460,942 7/1984 Pizzuti et al. .
4,486,997 12/1984 Roy .
4,507,714 3/1985 Aschinger et al. .
4,507,719 3/1985 Quiogue .
4,514,792 4/1985 Klaus .
4,525,406 6/1985 Pollock .
4,544,992 10/1985 Cover .
4,562,517 12/1985 Pankin .
4,572,859 2/1986 Fushiki et al. .
4,574,336 3/1986 Mikalonis .
4,574,337 3/1986 Poppenheimer .
4,581,285 4/1986 Mahefkey, Jr. .
4,678,959 7/1987 Mewissen .
4,682,276 7/1987 Miller .
4,700,521 10/1987 Cover .
4,751,627 6/1988 Usher .
4,754,377 6/1988 Wenman .
4,777,086 10/1988 Madden et al. .
4,847,140 7/1989 Jaskowski .
4,935,291 6/1990 Gunnink .
4,987,024 1/1991 Greenberg et al. .
5,034,869 7/1991 Choi .
5,188,885 2/1993 Timmons et al. .
5,190,810 3/1993 Kirschbaum et al. .

FOREIGN PATENT DOCUMENTS 0066855 12/1982 European Pat. Off. .
1932035 3/1978 Germany .
3214401A1 10/1983 Germany .
47-30360 8/1972 Japan .
51-10191 3/1976 Japan .
52-30072 7/1977 Japan .
1446167 8/1976 United Kingdom .
1517380 7/1978 United Kingdom .
2116693A 9/1983 United Kingdom .
2130353A 5/1984 United Kingdom .

OTHER PUBLICATIONS

"Specifications R+Aluminum Radiant Foil Energy Barrier", Published by Innovative Energy, Inc., (date unknown).

"Product Performance Chart/Appliance & Equipment Insulation", Published by the Johns-Manville Insulation Center, (date unknown).

"Air Handling System For Commercial, Residential and Industrial Air Conditioning and Heating Systems", Published by Manville Building Materials Corporation, (date unknown).

"Fiber Glass Equipment Insulation", Published by Manville Equipment Insulations, Microlight, (date unknown).

"Refractory Products" Published by Johns-Manville, (date unknown).

"Thermal Insulation and Accessories Manual", Oct. 1962, Published by Design and Construction Union Carbide Chemicals Company, Division of Union Carbide Corporation.

D. Fournier et al., "Heat Transmission Measurements In Thermal Insulations", Published by the American Society For Testing and Materials, Apr. 1973, pp. 223-242.

Engineering Drawings of Lightolier, Inc., (date unknown).

Deposition transcript of Mr. Julius Shaw.

"Thermal Insulation and Accessories Manual," Union Carbide Chemicals Company, Technical Center, South Carolina, West Virginia, Oct. 1962.

"Ashre Handbook & Product Directory," Chapter 50—Cryogenics, American Society of Heating, Refrigerating and Air-Conditioning Engineers, Inc., New York, 1978.

Glaser, P. E. et al. *Thermal Insulation Systems—A Survey,* NASA P-5027, Washington, D.C., 1967.

Stimpson, L. D. et al. "Predicting Spacecraft Multilayer Insulation Performance from Heat Transfer Measurements," *Heat Transmission Measurements in Thermal Insulations,* ASTM STP 544, American Society for Testing and Materials, 1974, 85-94.

Probert, S. D. et al. (eds.) *Thermal Insulation,* Elsevier Publishing Co., Ltd., New York, 1968.

Fournier, D. et al. "Some Recent Experimental Data on Glass Fiber Insulating Materials and Their Use for a Reliable Design of Insulations at Low Temperatures," *Heat Transmission Measurements in Thermal Insulations,* ASTM STP 544, American Society for Testing and Materials, 1974, 223-242.

Metalized Industrial Technologies Ad, *Home Lighting and Accessories,* Sep. 1983, p. 133.

Transcript of Craig H. Cover, Apr. 8, 1994, pp. 1-4; 202-214 and Exhibits 11 and 12 E.D.PA. Case No. 93-CV-6400 (M.P.E.P. § 2717,2258).

*Primary Examiner*—Richard R. Cole

[57] ABSTRACT

The present invention is directed to a lighting fixture thermal insulating system which incorporates the space-age technology of layered metallized polymer insulation. The present invention utilizes a structure and combination which yields an insulation system of superior performance while being cost competitive and because of reduced space requirement creates greater freedom of design in the manufacture of lighting fixtures. The laminations of metallized polymer and a spacer material may be located above or below the mounting pan or both. For reasons of economy, simple aluminum foil may be used to replace the metallized polymer with only slightly reduced performance.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–8 is confirmed.

* * * * *